US006039106A

United States Patent [19]

Gontarski et al.

[11] Patent Number: 6,039,106

[45] **Date of Patent: *Mar. 21, 2000**

[54] DOOR WITH ARTICULATED CAM

[75] Inventors: Christopher J. Gontarski, Sugar Hill; Steven D. Ogden, Lawrenceville; John J. Gannon, Jr., Snellville, all of Ga.

[73] Assignee: Albany International Corp., Albany, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/004,790

[22] Filed: Jan. 9, 1998

[51] Int. Cl.[7] ..... E05D 15/16

[52] U.S. Cl. ..... 160/201; 292/228; 292/DIG. 65

[58] Field of Search ..... 160/201, 265, 160/207, 271, 272, 273.1, 133, 229.1, 213; 292/228, 210, DIG. 4, DIG. 36, DIG. 65; 16/94 R, 94 D, 95 R, 95 D, 96 R, 96 D

[56] References Cited

U.S. PATENT DOCUMENTS 5,025,847 6/1991 Mueller ..... 160/265 X
5,271,448 12/1993 Delgado ..... 160/271 X
5,299,617 4/1994 Hying et al. ..... 160/265 X
5,535,805 7/1996 Kellogg et al. ..... 160/201
5,601,133 2/1997 Krupke et al. ..... 160/271 X
5,620,039 4/1997 Delgado et al. ..... 160/265
5,638,883 6/1997 Schulte ..... 160/265 X

*Primary Examiner*—David M. Purol
*Attorney, Agent, or Firm*—Kane, Dalsimer, Sullivan and Levy, LLP

[57] ABSTRACT

The device is an articulated cam with an at least partially rotatable cam arm for mounting a vertical traveling industrial door, constructed from a series of hinged solid panels, to a guide track. The cam arm has a threshold force required for rotation as the cam arm includes a dimple which is engaged by a spring-biased nipple. When this threshold force occurs due to impact on the door, the cam arm rotates and the articulated cam and the door break away from the guide track.

17 Claims, 12 Drawing Sheets

DOOR WITH ARTICULATED CAM

BACKGROUND OF THE INVENTION

1. Field of the Invention

This invention relates to a panel door with an articulated break-away cam design which engages guide tracks. Upon impact, articulating break-away devices pivot on an axis and allow the door to slide free of the fixed guide track with little or no damage to the door. The design of the break-away devices allows for simple resetting of the door.

2. Description of the Prior Art

Many industrial locations, such as warehouses and factories, have high traffic of vehicles, such as forklifts. Such locations frequently have accidents where the vehicles strike a large industrial door. In order not to disrupt the operation of the industrial location, it is important to be able to avoid or minimize any damage, if possible, and further to reset any impacted door quickly.

These concerns have been addressed by the use of flexible curtains in place of doors, these flexible curtains pulling out of the guide tracks upon impact with minimized damage. Such doors are disclosed in U.S. Pat. No. 4,478,268 to Palmer entitled "Door Structure". A variation of this concept is shown in U.S. Pat. No. 4,601,320 to Taylor entitled "Industrial Door".

However, there are still many industrial locations where a flexible curtain door is not desired, such as exterior doors which lead to the outside where a solid door is desirable for security purposes, particularly when the door is fully closed. U.S. Pat. No. 5,535,805 to Kellogg et al. entitled "Overhead Door" uses a linear reciprocating plunger which engages a guide track with one or both sides of the track including an angled disengagement portion. However, this structure requires a complicated plunger arrangement which, along with the guide track, is expensive to manufacture and difficult to maintain.

OBJECTS AND SUMMARY OF THE INVENTION

It is therefore an object of this invention to provide a mechanism to minimize damage to an industrial door upon impact by a motor vehicle or similar object.

It is therefore a further object of this invention to provide such a mechanism for an industrial door while maintaining security of the premises, particularly when the door is fully closed.

It is therefore a further object of this invention to provide such a mechanism for an industrial door, the door being comprised of solid components, rather than a flexible curtain.

It is therefore a further object of this invention to provide such a mechanism for an industrial door, the mechanism being simple in design for economy in manufacture and maintenance.

These and other objects are attained by providing an articulated cam for use with a vertically traveling door comprised of solid panels. The articulated cam includes a cam arm which engages the guide track of the door. The cam arm includes an interior proximal portion which rotates upon a vertical axis in a body mechanically fastened to the door. However, the interior proximal portion includes an indentation which is engaged by a spring-loaded nipple. This indentation engaged by a spring-loaded nipple inhibits rotation of the cam arm below a threshold force. This threshold force can be adjusted by a set screw in the body of the articulated cam which engages the spring thereby varying the spring-loaded force of the nipple.

The cam arm engages the guide track of the door during ordinary operation. However, upon impact to the door, the threshold rotation force on the cam arm is exceeded, the cam arm rotates and thereby disengages from the guide track. This allows the door to break away from the guide track with minimized damage. To reset the door, the rotated cam arm is placed back into the guide track and the door is pushed back into place, thereby rotating the cam arm back to its home position as engaged by the spring-loaded nipple.

The walls of the guide track can be manufactured with various lengths throughout the entire length or a portion of the length in order to allow the door to break away in both directions, one direction or neither direction. In particular, for security purposes, it may be desirable to limit the breakaway ability of the door from impacts from the outside. Similarly, in areas of the guide track which are engaged only when the door is in its fully closed position, it may be desirable to limit the breakaway ability of the door in either direction.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
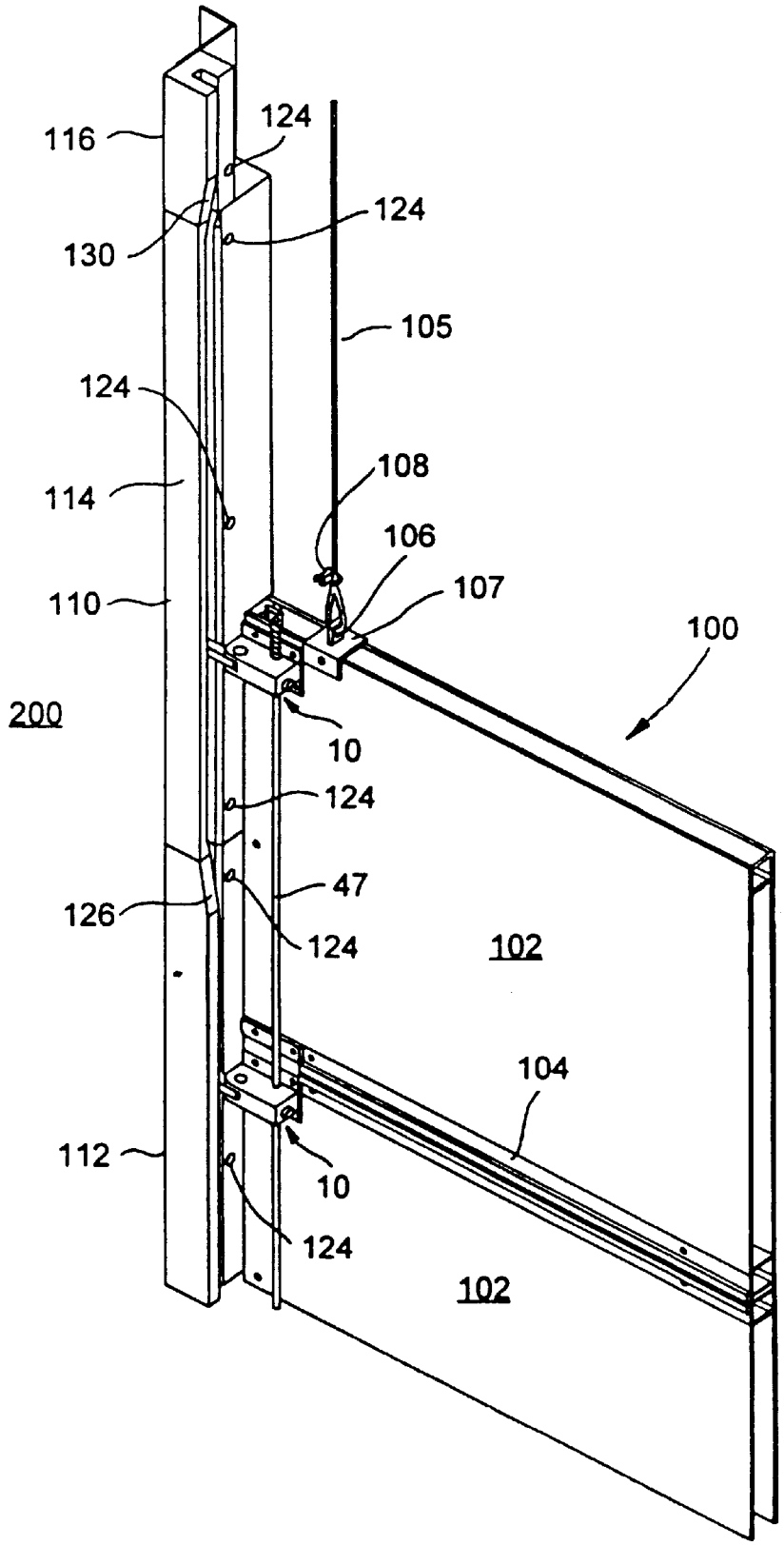
FIG. 1 is a perspective view of two panels of the industrial door, including the articulated cam of the present invention.

Referring now to the drawings in detail, wherein like numerals refer to like elements throughout the several views, one sees that FIG. 1 is a perspective view of a vertically traveling industrial door 100 comprised of solid door panels 102 hinged together by horizontal hinges 104 and lifted by cable 105 which passes through aperture 106 of fastener 107 at the top of door 100 and is illustrated as looped and secured to itself via clamp 108. The second end of cable 105 is typically attached to a spool (not shown) driven by a rotary motor (not shown). While a single side of the industrial door 100 is illustrated, the second side is essentially a mirror image of the illustrated side. Articulated cams 10 are positioned at the ends of horizontal hinges 104 with cam arms 12 which extend into stationary guide track 110 which is affixed to wall 200. Guide track 110 is comprised of lower guide track portion 112 (see also FIGS. 12 and 13), intermediate guide track portion 114 (see also FIGS. 14 and 15) and upper guide track portion 116 (see also FIGS. 16 and 17). As will be explained in more detail hereinafter, the guide track portions 112, 114, 116 include different cross sections in order to vary the break-away characteristics of articulated cam 10 dependent upon the position of articulated cam 10, and hence door 100 within guide track 110.

Figure 2:
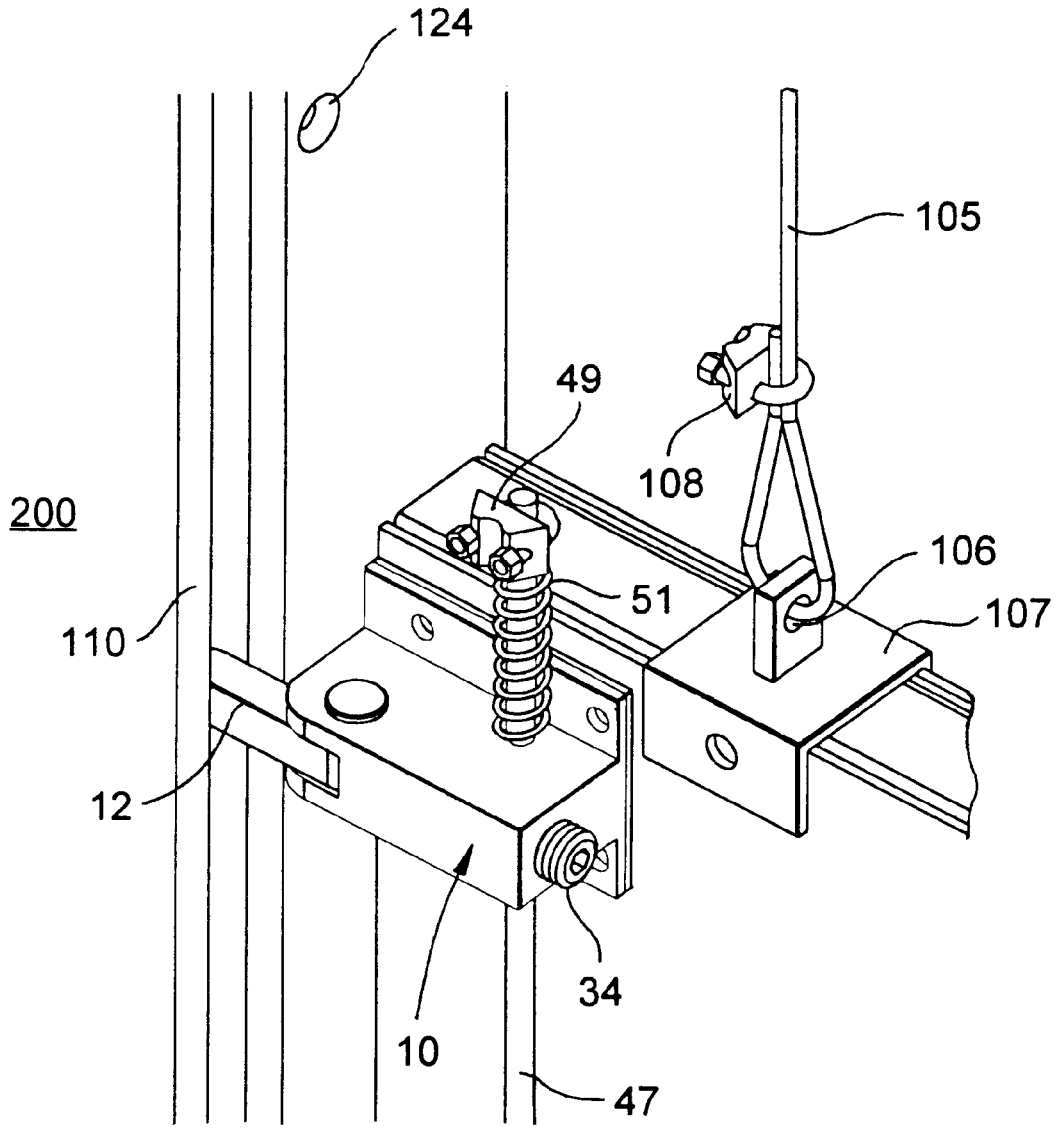
FIG. 2 is a perspective view of the articulated cam of the present invention, in the context of the industrial door.

FIG. 2 shows the engagement of the articulated cam into guide track 110 for a single articulated cam 10, including further detail to that illustrated in FIG. 1.

As shown in FIGS. 3–7, articulated cam 10 includes body 14 of generally rectangular or parallelpiped shape. Body 14 is integral with rectangular flange plate 16 which extends upwardly and downwardly from the rear face of body 14. Rectangular flange plate 16 includes apertures 18 which allow body 14 to be fastened securely to a solid door panel 102 by bolts or similar devices (see FIG. 2).

Figure 3:
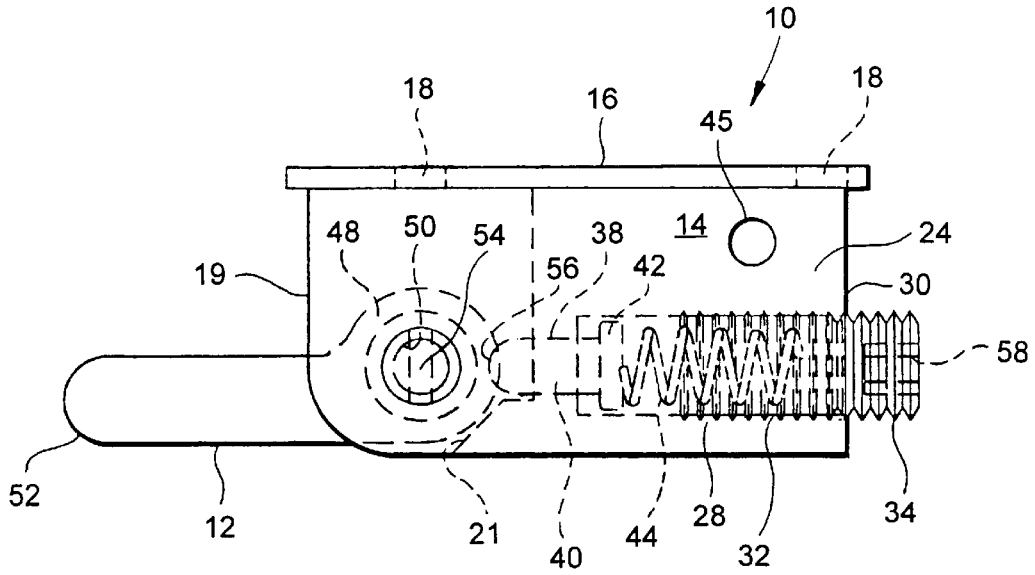
FIG. 3 is a top plan view, partially in cross section, of the articulated cam of the present invention.
Figure 4:
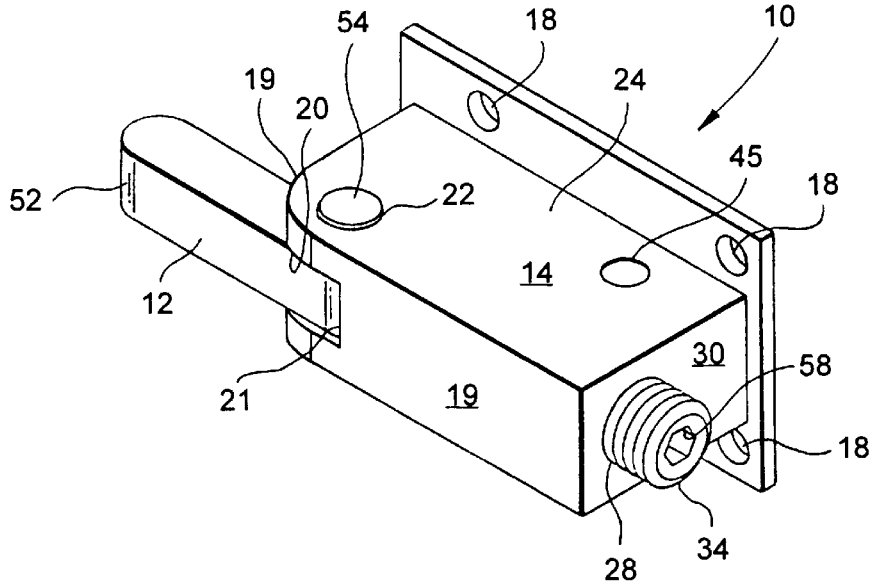
FIG. 4 is a perspective view of the articulated cam of the present invention.
Figure 5:
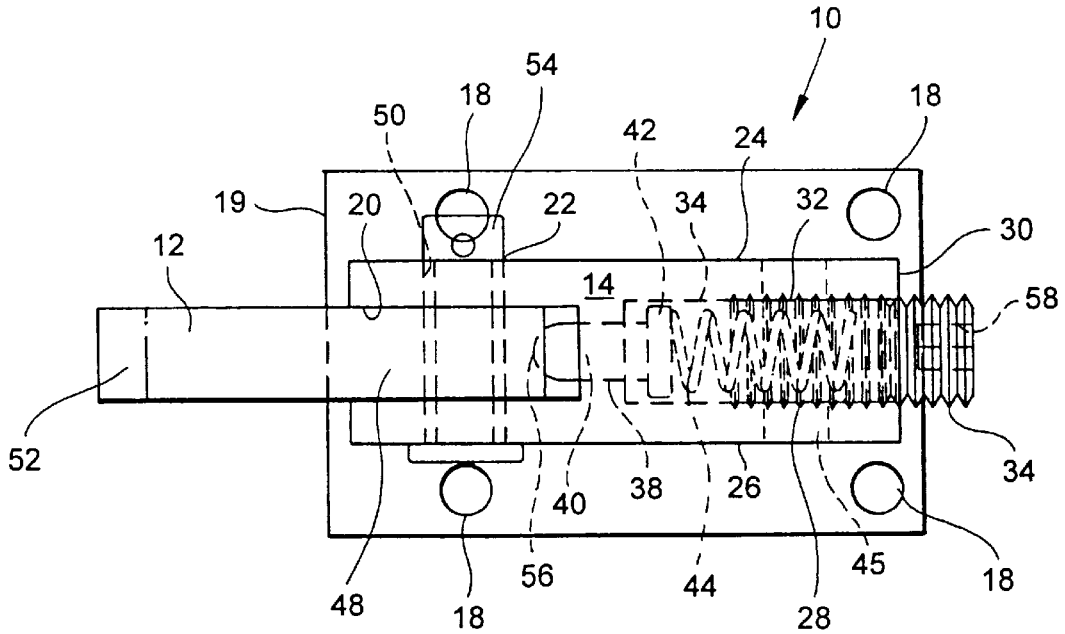
FIG. 5 is a side plan view, partially in cross section, of the articulated cam of the present invention.
Figure 6:
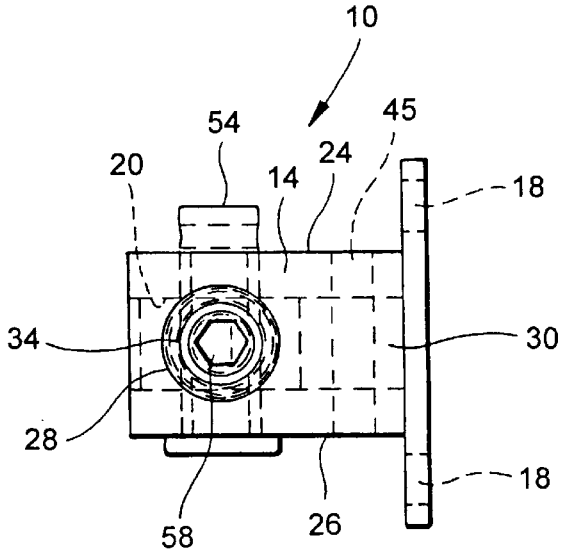
FIG. 6 is a rear plan view, partially in cross section, of the articulated cam of the present invention.

The front lateral side 19 of body 14 includes horizontal slot 20 in which cam arm 12 rotates. Rivet aperture 22 extends vertically from an upper surface 24 of body 14 to a lower surface 26 of body 14, extending through a portion of horizontal slot 20. As shown in FIGS. 3, 7 and 8–11, horizontal slot 20 includes forwardly extended bevel wall 21 to limit the rotation of cam arm 12 to the position shown in FIG. 11. Body 14 further includes spring aperture 28 which extends longitudinally from rear surface 30 to horizontal slot 20. As shown in FIGS. 3 and 5, spring aperture 28 includes three portions—threaded portion 32 which is immediately inwardly adjacent from rear surface 30 and which threadedly engages set screw 34, unthreaded portion 36 inwardly adjacent from threaded portion 32, and nipple aperture 38 of reduced diameter which joins unthreaded portion 36 to horizontal slot 20. Nipple 40 includes two portions—rearward cylindrical disk portion 42 which travels within unthreaded portion 36 of spring aperture 28 and abuts coil spring 44, and forward hemispherical portion 46 which travels within nipple aperture 38 as biased by coil spring 44 and abuts cam arm 12.

Additionally, vertical aperture 45 extends through body 14. As shown in FIGS. 1 and 2, reset cable 47 extends through vertical apertures 45 of successive articulated cams 10 and is secured at its ends by clamp 49 which abuts coil spring 51 against articulated cam 10. As explained hereinafter, user can pull reset cable 47 to pull door 100 back into operating position after it has released from track 110.

Figure 7:
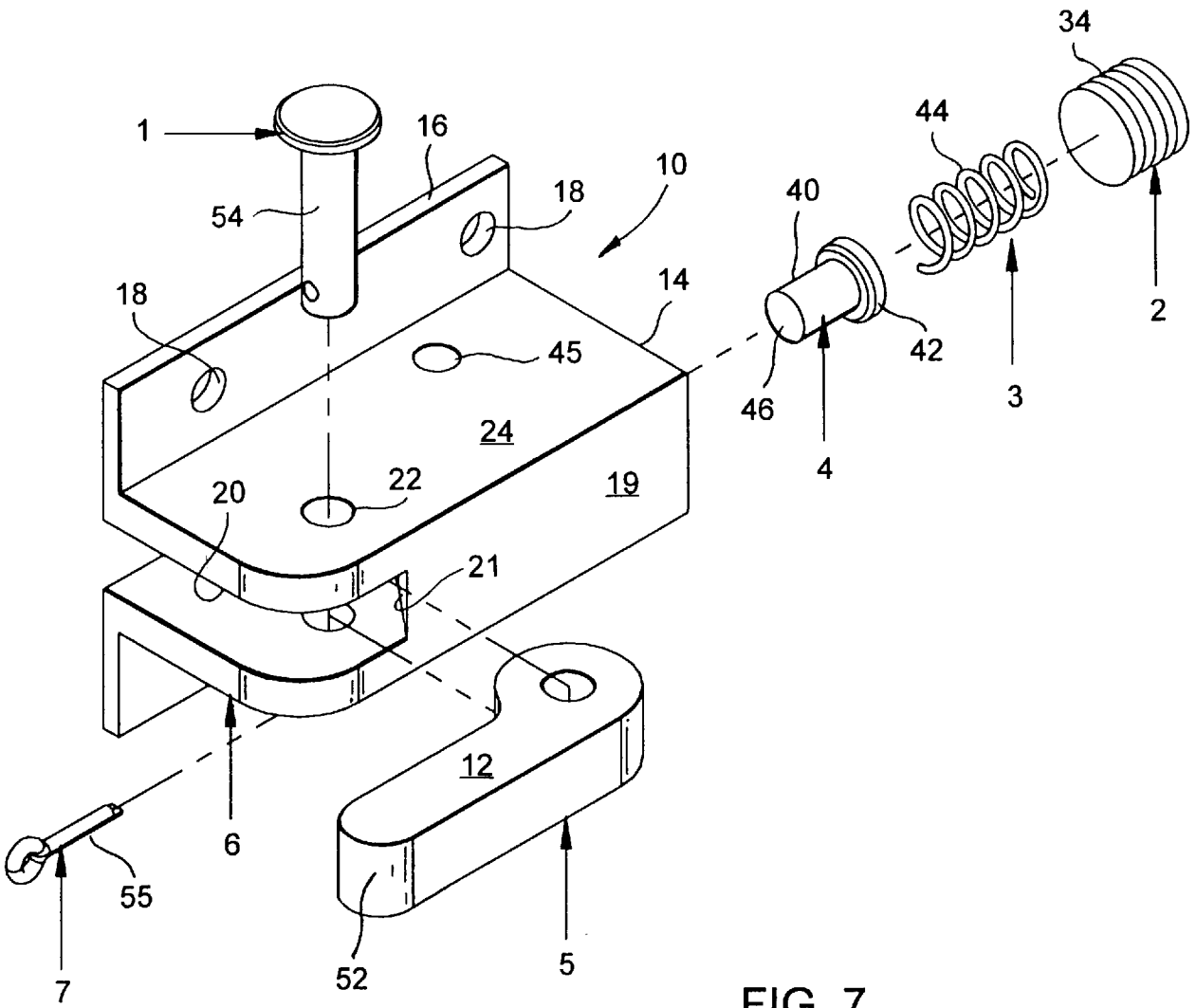
FIG. 7 is an exploded view of the articulated cam of the present invention.

Cam arm 12 includes an interior proximal rounded portion 48 with a central aperture 50. Cam arm 12 further includes distal arm 52. Central aperture 50 is aligned with rivet aperture 22 of body 14 and rivet 54 is inserted therethrough thereby journalling cam arm 12 for partial rotation. Rivet 54 is secured in place by cotter pin 55 or other suitable attachment devices as shown in FIG. 7. Interior proximal rounded portion 48 includes dimple 56 which is engaged by forward hemispheric portion 46 of nipple 40 as biased by coil spring 44 thereby positioning distal arm 52 in the longitudinally outward orientation necessary to engage guide track 110 (see FIGS. 1, 2 and 8). The degree of force applied by nipple 40 onto dimple 56 of interior proximal rounded portion 48 of cam arm 12 can be adjusted by rotating set screw 34 by a hex wrench (not shown) engaging hexagonal aperture 58 of set screw 34. The degree of force applied by nipple 40 to dimple 56 determines the rotational breakaway force applied to distal arm 52 which will cause cam arm 12 to rotate thereby rotating dimple 56 away from nipple 40 and allowing the cam arm 12, and hence door 100, to break away from the guide track 110 as shown in FIGS. 9–11. Additionally, this configuration allows the user, after the cam arm 12 has rotated and the door "broken away" as shown in FIG. 11, to reset the door relatively quickly and easily by inserting cam arm 12 into guide track 110 and pushing the door 100 or pulling reset cable 47 until the cam arm 12 rotates back into its position as shown in FIGS. 1, 2 and 8, the nipple 40 engaging dimple 56.

Figure 8:
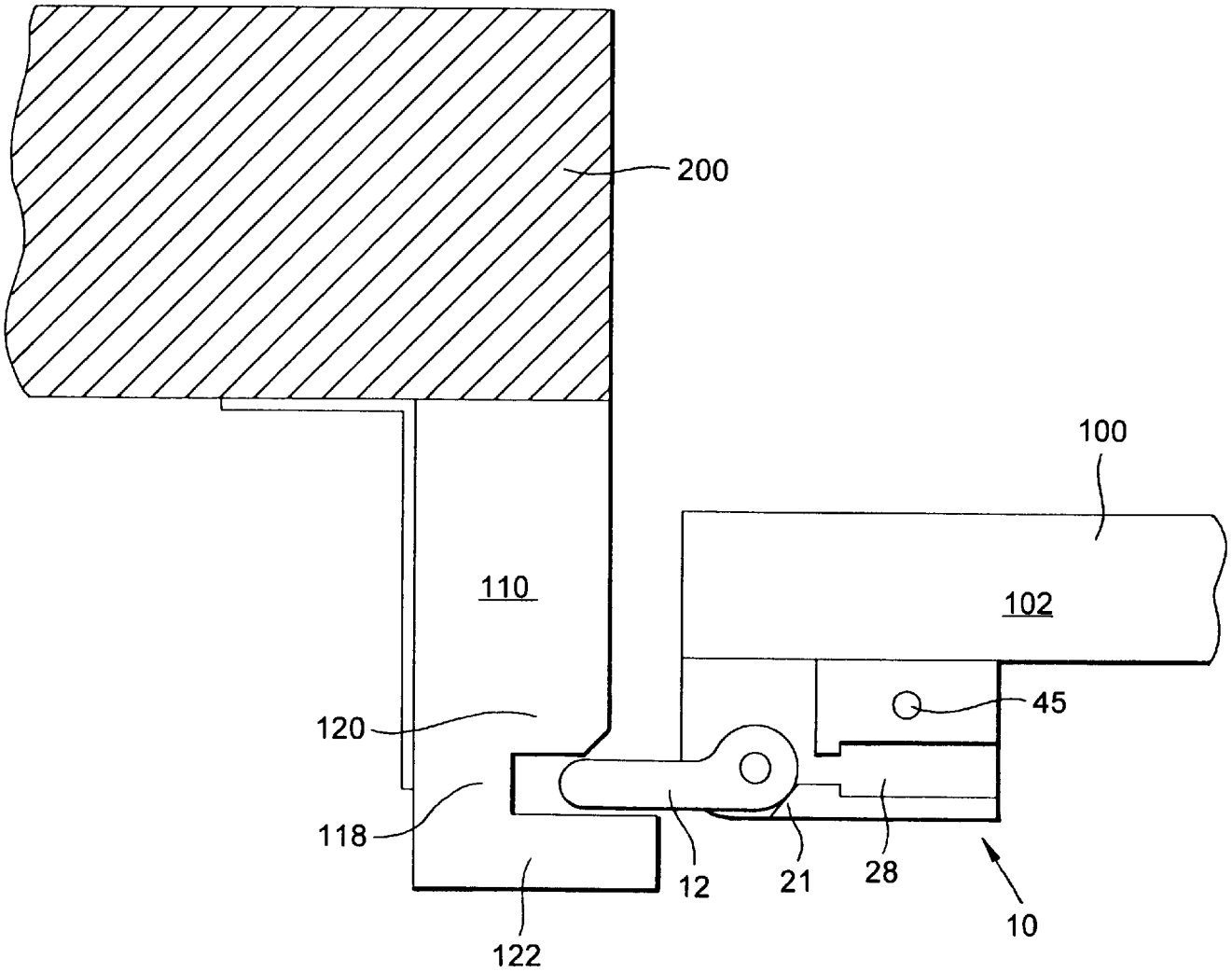
FIG. 8 is a top plan view, partially in cross section, of the articulated cam of the present invention in its ordinary position free of rotation.
Figure 9:
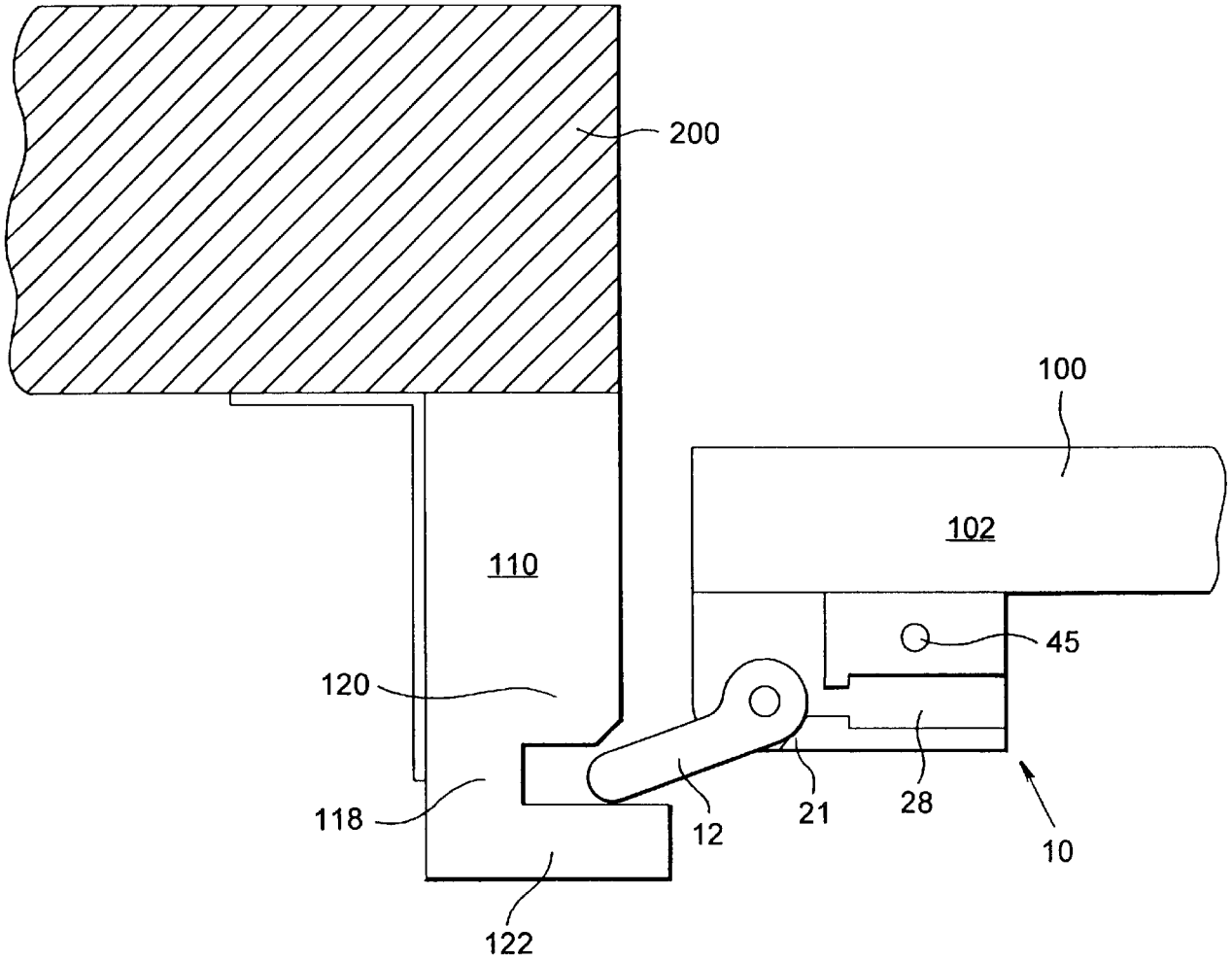
FIG. 9 is a top plan view, partially in cross section, of the articulated cam of the present invention rotated through twenty degrees from its ordinary position.
Figure 10:
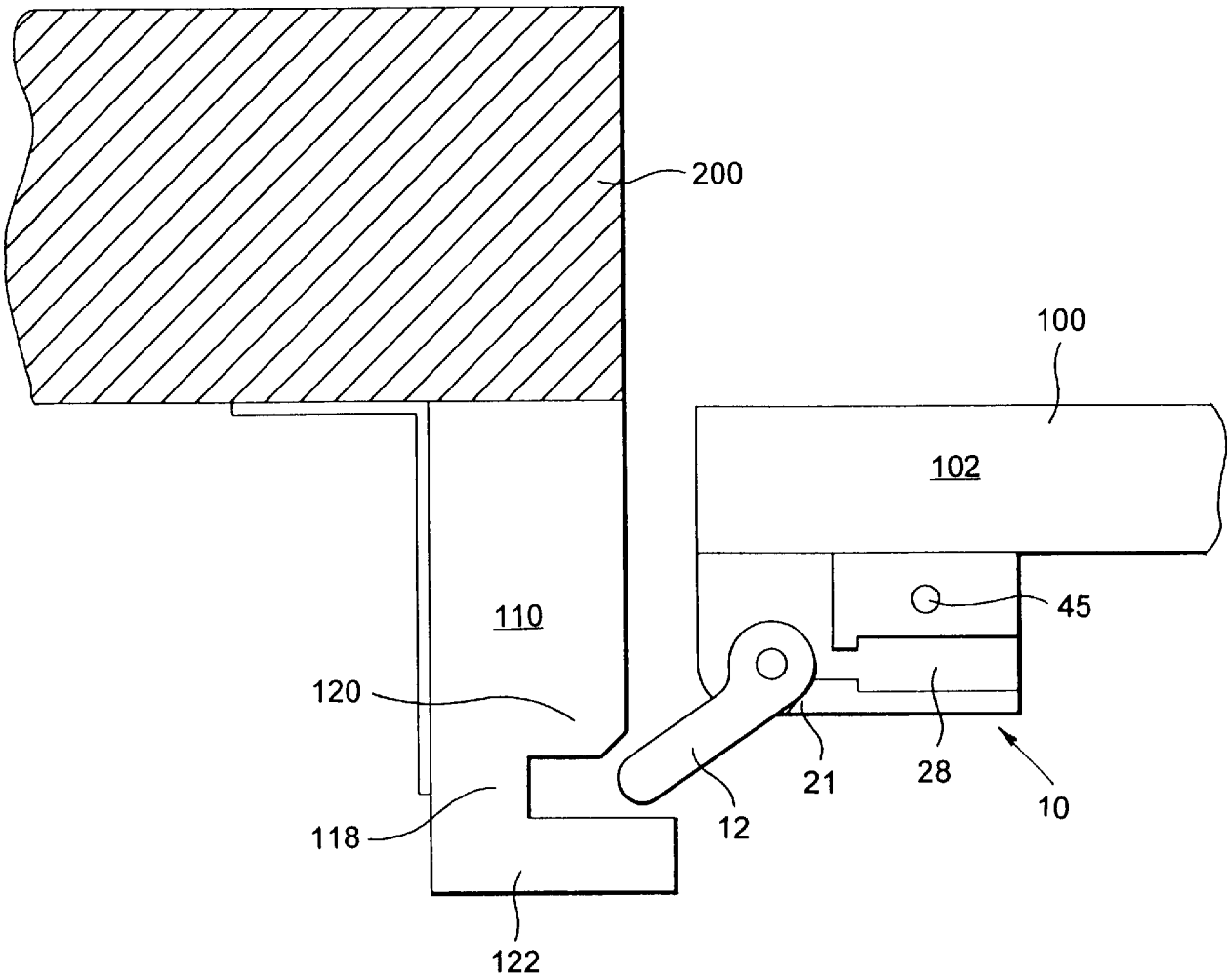
FIG. 10 is a top plan view, partially in cross section, of the articulated cam of the present invention rotated through thirty-five degrees from its ordinary position.
Figure 11:
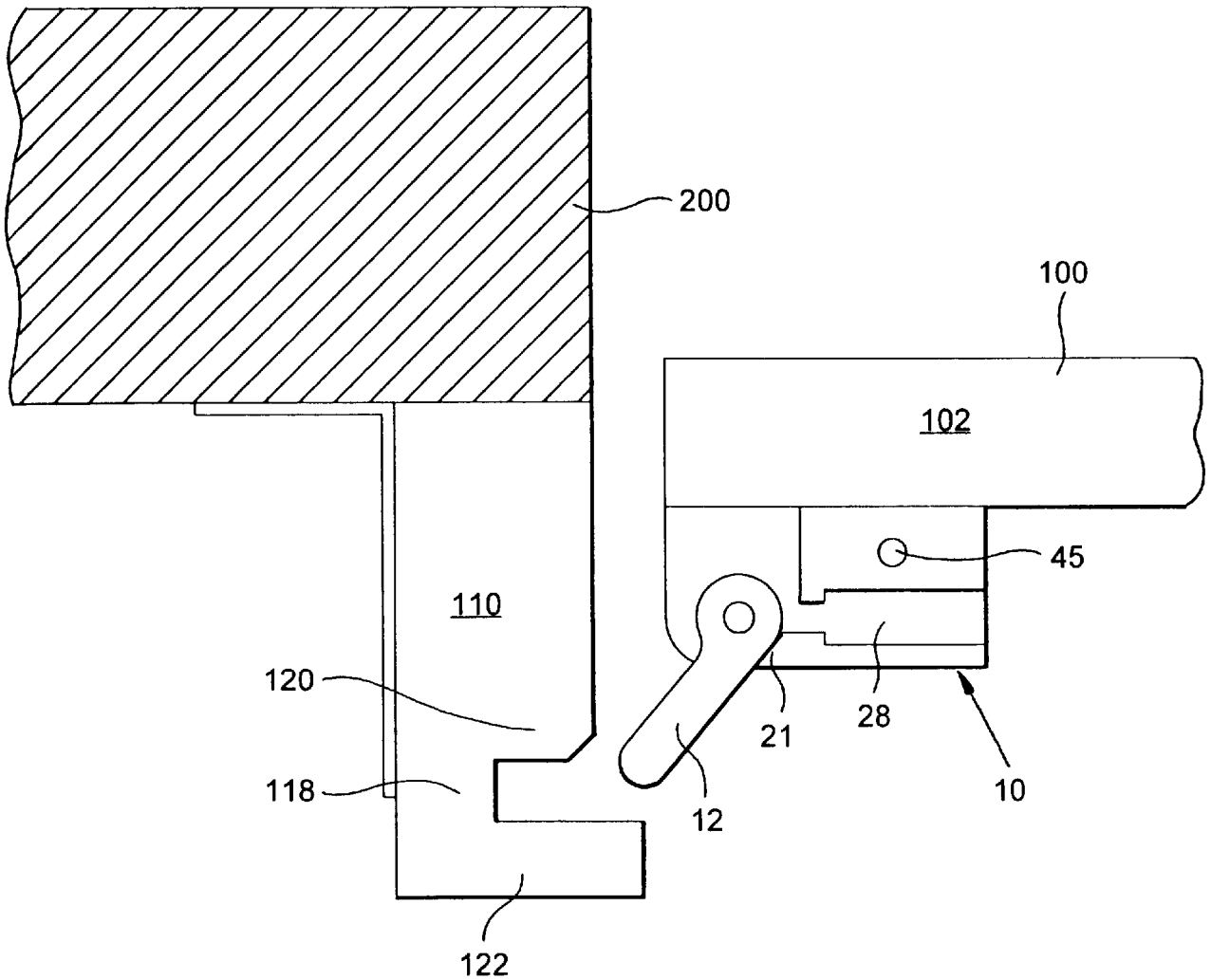
FIG. 11 is a top plan view, partially in cross section, of the articulated cam of the present invention rotated through fifty degrees from its ordinary position and released from the guide track.

FIGS. 8–11 show the position of door 100 starting at its ordinary operating position in FIG. 8 and moving through increased displacement, that is, increased rotation of cam arm 12, until the fully released position is shown in FIG. 11.

Figure 12:
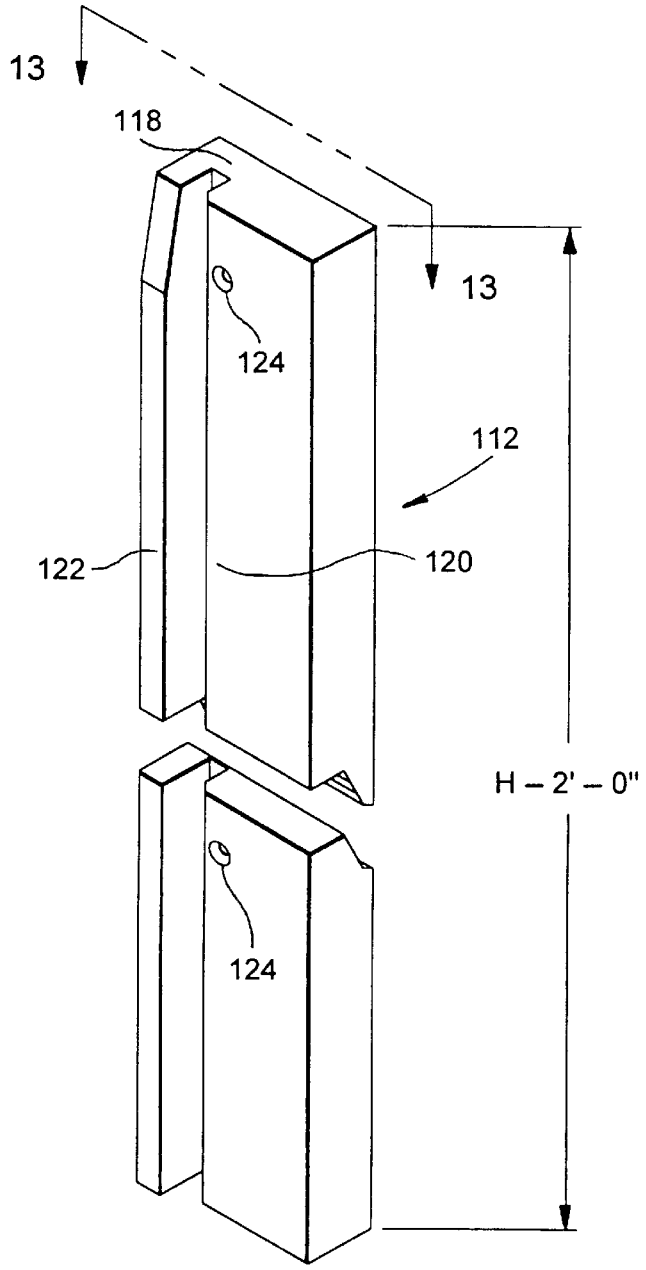
FIG. 12 is a perspective view of the lower portion of the guide track as used with the present invention.
Figure 13:
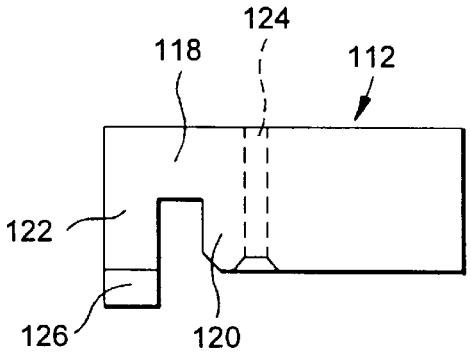
FIG. 13 is a cross-sectional view of the lower portion of the guide track of FIG. 12.
Figure 14:
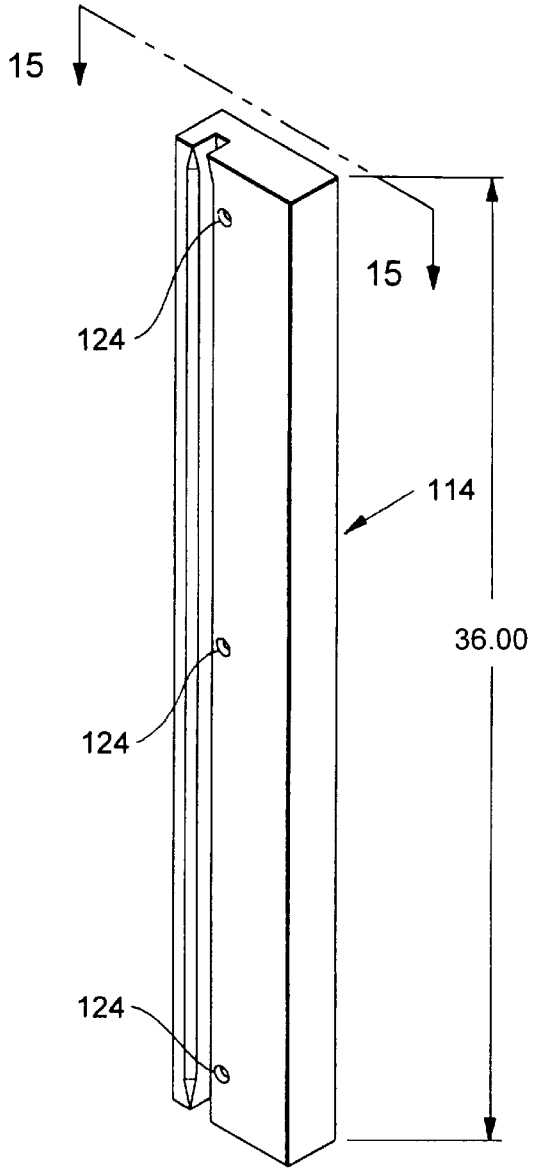
FIG. 14 is a perspective view of the intermediate portion of the guide track as used with the present invention.
Figure 15:
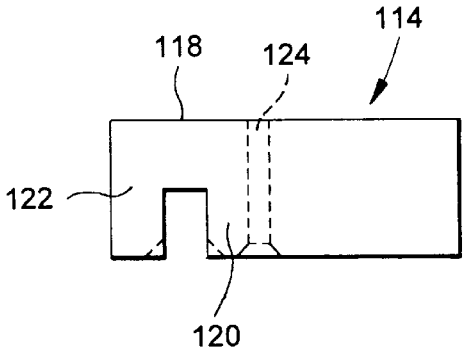
FIG. 15 is a cross-sectional view of the intermediate portion of the guide track of FIG. 14.
Figure 16:
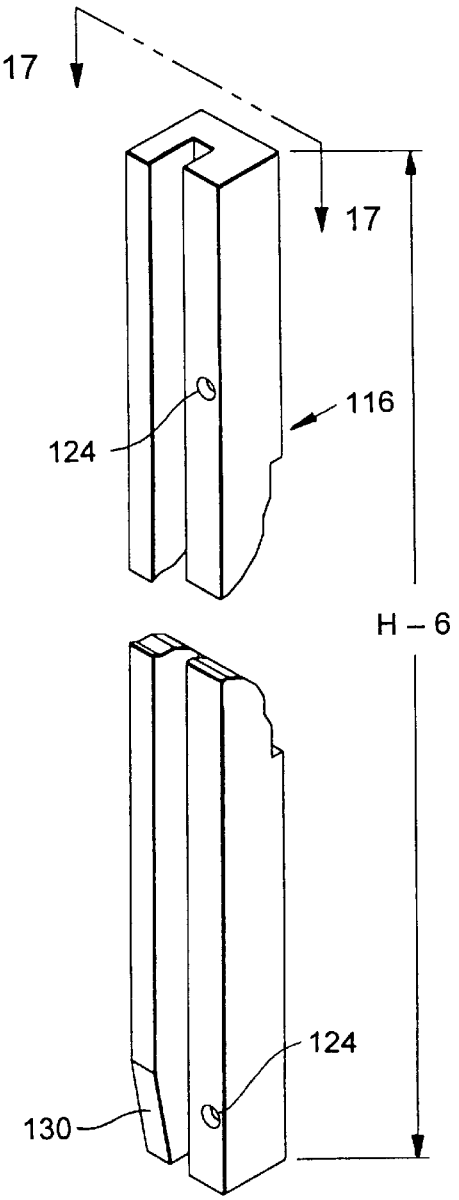
FIG. 16 is a perspective view of the upper portion of the guide track as used with the present invention.
Figure 17:
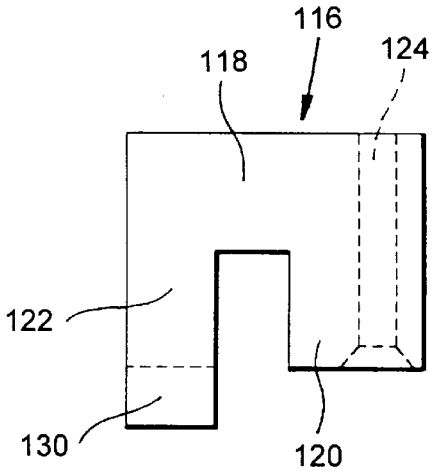
FIG. 17 is a cross-sectional view of the upper portion of the guide track of FIG. 16.

As shown in FIGS. 12–17, guide track 110 as formed by lower, intermediate and upper guide track portions 112, 114, 116 typically has a C-shaped cross section formed by support section 118, outer arm 120, and inner arm 122. Outer arm 120 includes countersunk apertures 124 to allow attachment to the wall 200 by a screw (not shown) or similar attachment device. The lengths of outer arm 120 and inner arm 122 can be varied to allow or restrict the rotation of cam arm 12 thereby allowing or preventing the door 100 from releasing or breaking away in one or both directions. Lengthening inner arm 122 prevents the door 100 from releasing or breaking away inwardly. Likewise, lengthening outer arm 120 prevents the door 100 from releasing or breaking away outwardly. As shown in FIGS. 12 and 13, lower guide track portion 112 includes a lengthened inner arm 122 to prevent the door 100 from releasing or breaking away inwardly and an outer arm 120 of reduced length to allow the door 100 to release or break away outwardly in positions near the closed position of the door. It would also be common to lengthen both inner arm 122 and outer arm 120 at lower positions to ensure that when door 100 was in its fully closed position that security was maintained. Inner arm 122 of lower guide track portion 112 further includes an inwardly extending bevel portion 126 (also see FIG. 1) to provide a smooth transition to intermediate guide track portion 114 which includes outer arm 120 and inner arm 122 of approximately equal reduced lengths thereby enabling door 100 to release or break away in either direction when impacted at intermediate heights (see FIGS. 14 and 15). Upper guide track portion 116 includes an outer arm 122 which is lengthened, similar to lower guide track portion 112, in order to allow the door 100 to release or break away outwardly but not inwardly. Outer arm 122 includes a lower inwardly bevelled portion 130 to allow for a smooth transition to intermediate guide track portion 114. Additionally, the lengthened inner arms 122 of lower and upper guide track portions 112, 116 function to "catch" or engage rotated cam arm 12 as door 100 swings back toward its engaged position after releasing, with or without the aid of the operator pulling on reset cable 47 of FIGS. 1 and 2.

To use the door 100 including articulated cams 10, the door 100 is mounted with all of the cam arms 12 extending outwardly so as to engage guide track 110, all nipples 40 engaging dimples 56. Set screws 34 are adjusted with hex wrenches (not shown) to provide the desired amount of force by nipples 40 against dimples 56 thereby adjusting the breakaway force. Upon impact, the distal arms 52 of cam arms 12 rotate and articulated cams 10 allow the door 100 to break away from guide track 110 with minimized damage. The door 100 may swing back into an engaged position by itself. However, if necessary, the user then rotates cam arms 12 to engage guide track 110 and/or pushes door 100 directly and/or pulls door 100 via reset cable 47 to rotate cam arms 12 so that the distal arms 12 return to the biased position wherein nipples 40 bear against dimples 56.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A door assembly including:

a vertically traveling door, guide tracks adjacent to said vertically traveling door, said guide tracks being relative stationary, a body fixedly mounted on said vertically traveling door, said body including a vertical axis, an arm assembly pivotably mounted on said vertical axis, said arm assembly pivoting between a first position extending directly into said guide tracks and a second position disengaged from said guide tracks, and means for inhibiting pivoting of said arm assembly from said first position below a threshold force.

2. The door assembly of claim 1 wherein said body includes a horizontally oriented slot in which said arm assembly is pivotably mounted.

3. The door assembly of claim 2 wherein a first aperture in said body is aligned with a second aperture in said arm assembly and a pivot device is inserted through said first aperture and said second aperture.

4. The door assembly of claim 3 wherein said means for inhibiting pivoting includes a depression in said arm assembly which is engaged by a protrusion.

5. The door assembly of claim 4 wherein said protrusion is resiliently biased against said depression.

6. The door assembly of claim 5 wherein said protrusion is resiliently biased against said depression by a spring.

7. The door assembly of claim 6 wherein said spring is a coil spring housed within a passageway of said body.

8. The door assembly of claim 7 wherein said passageway extends from a rear portion of said body to said horizontally oriented slot.

9. The door assembly of claim 8 including means for varying the resilient biasing of said protrusion.

10. The door assembly of claim 9 wherein said means for varying the resilient biasing of said protrusion comprises a set screw engaged by a threaded portion of said passageway proximate to said rear portion of said body.

11. The door assembly of claim 1 further including a plurality of said bodies mounted on said vertically travelling door and a cable travelling between said bodies thereby providing a means for resetting said arm assembly from said second position to said first position.

12. A device for engaging a vertically traveling door to guide tracks, including:

a body for mounting on the vertically traveling door, said body including a horizontal slot, a first aperture defining a vertical axis, and a passageway extending from a rear portion of said body to said horizontal slot, an arm assembly pivotably mounted within said horizontal slot on said vertical axis said arm assembly including a second aperture aligned with said first aperture, a pivot device inserted through said first and second apertures, said arm assembly pivoting between a first position engaging the guide tracks and a second position disengaged from the guide tracks, means for inhibiting pivoting of said arm assembly from said first position below a threshold force, said means for inhibiting including a depression in said arm assembly and a protrusion resiliently biased against said depression by a coil spring housed within said passageway in said body, means for varying resilient biasing of said protrusion comprising a set screw engaged by a threaded portion of said passageway proximate to said rear portion of said body, and wherein said passageway has a first diameter proximate to said coil spring and proximate to said threaded portion and a second diameter as said passageway meets said horizontally oriented slot, said first diameter being larger than said second diameter.

13. The device of claim 12 wherein said protrusion includes a nipple assembly with a hemispherical portion of said second diameter engaging said depression and a cylindrical portion of substantially said second diameter engaging said coil spring.

14. The device of claim 13 wherein said horizontally oriented slot includes a bevelled surface for limiting pivoting of said arm assembly.

15. The device of claim 14 wherein said arm assembly includes a rounded proximal portion including said second aperture and an extending cam arm portion for engaging the guide tracks.

16. The device of claim 15 wherein said second aperture is substantially centered within said rounded proximal portion.

17. The device of claim 16 wherein said body includes a vertical aperture through which a reset cable passes.

* * * * *